US012622539B2

(12) United States Patent
Tanaka et al.

(10) Patent No.: US 12,622,539 B2
(45) Date of Patent: May 12, 2026

(54) HOLDER

(71) Applicant: KURA SUSHI, INC., Sakai (JP)

(72) Inventors: Kunihiko Tanaka, Osaka (JP); Naoki Sakamoto, Osaka (JP)

(73) Assignee: KURA SUSHI, INC.

( * ) Notice: Subject to any disclaimer, the term of this patent is extended or adjusted under 35 U.S.C. 154(b) by 0 days.

(21) Appl. No.: 18/894,819

(22) Filed: Sep. 24, 2024

(65) Prior Publication Data

US 2025/0098883 A1 Mar. 27, 2025

(30) Foreign Application Priority Data

Sep. 26, 2023 (JP) ..... 2023-162912

(51) Int. Cl.

| | |
|---|---|
| ***B65D 1/34*** | (2006.01) |
| ***A47G 23/06*** | (2006.01) |
| ***A47J 47/14*** | (2006.01) |
| ***B65D 85/00*** | (2006.01) |
| *A45C 11/20* | (2006.01) |
| *A47G 19/02* | (2006.01) |
| *B65D 1/36* | (2006.01) |

(52) U.S. Cl.

CPC ..... *A47G 23/0683* (2013.01); *A45C 11/20* (2013.01); *A47G 19/02* (2013.01); *A47G 2023/0691* (2013.01); *B65D 1/34* (2013.01); *B65D 1/36* (2013.01)

(58) Field of Classification Search

CPC ..... A47G 23/0683; A47G 23/06; A47G 2023/0691; A47G 19/2272; A47J 39/006; B65D 1/24; B65D 1/34; B65D 1/36; B65D 43/02; B65D 45/16; Y10S 229/904; A45C 11/20

USPC ..... 220/574

See application file for complete search history.

(56) References Cited

U.S. PATENT DOCUMENTS 3,164,285 A * 1/1965 Melich ..... A47J 39/02 206/508
3,799,386 A * 3/1974 Madalin ..... B65D 81/3834 206/564
3,938,688 A * 2/1976 Ryan ..... B65D 1/36 206/541
D261,586 S * 11/1981 Herbst ..... D7/538
4,545,487 A * 10/1985 Asmus ..... B65D 81/383 206/508

(Continued)

FOREIGN PATENT DOCUMENTS

JP 2022-016238 A 1/2022

*Primary Examiner* — Gideon R Weinerth
(74) *Attorney, Agent, or Firm* — Yusuke Hirai; Best Mode IP Law, PLLC

(57) ABSTRACT

A holder houses a container of a fluid to be conveyed. The holder has a holder body having a bottom wall and a first side wall extending upward from a peripheral edge of the bottom wall, and a lid body having a top surface and a second side wall extending downward from a peripheral edge of the top surface. The lid body opens and closes an upper opening defined by an upper end of the first side wall. In a state where the container is housed in the holder, the upper end of the first side wall and a lower end of the second side wall are positioned below an upper end of the container, the top surface or the second side wall is in contact with the container or has a gap with the container such that the container is suppressed to tilt at a particular angle or more.

16 Claims, 9 Drawing Sheets

(56) References Cited

U.S. PATENT DOCUMENTS

| | | | | |
|---|---|---|---|---|
| 5,116,240 | A * | 5/1992 | Wischhusen | B65D 81/3834 206/499 |
| 5,497,883 | A * | 3/1996 | Monetti | A47J 39/006 294/166 |
| 7,419,057 | B2 * | 9/2008 | Avery | A47J 36/06 220/521 |
| D616,258 | S * | 5/2010 | Miros | D7/629 |
| 8,328,034 | B2 * | 12/2012 | Miros | B65B 7/16 220/23.88 |
| 8,621,885 | B1 * | 1/2014 | Niebolte | F25D 3/08 62/457.4 |
| 2016/0022074 | A1 * | 1/2016 | Martin | A47G 23/0266 29/525 |
| 2023/0218098 | A1 | 7/2023 | Tanaka et al. | |

* cited by examiner

HOLDER

CROSS-REFERENCE TO RELATED APPLICATIONS

This application is based on and claims priority under 35 USC 119 from Japanese Patent Application No. 2023-162912 filed on Sep. 26, 2023, the entire content of which is incorporated herein by reference.

TECHNICAL FIELD

The present disclosure relates to a holder.

BACKGROUND ART

JP2022-016238A discloses a housing body with a lid body, which houses a container on which a food and/or beverage item is to be placed. The housing body is assumed to be used in a restaurant equipped with a food and/or beverage item transport apparatus. The food and/or beverage item transport apparatus has a conveyance path that revolves along seats for customers in the restaurant. The food and/or beverage item on the container is placed on the conveyance path to be conveyed to the seats. Typically, the house body is preferably used in a restaurant generally called a conveyor belt sushi restaurant, in which sushi on dishes are placed on the conveyance path and provided to the seats.

In a restaurant as described above, not only sushi but also menu items such as steamed egg custard, soup in a bowl, and beverages are provided on a daily basis. Such a soft food or a beverage, which is in a container such as a "bowl" or a drink cup, may be put in a deep dish, placed on the conveyance path, and conveyed to the seats. Customers at the seats can take out desired deep dishes from the conveyance path, and thereby obtain the food or the beverage in the container.

However, since the container housing the soft food or the beverage has a certain depth, the container tends to be instable. For this reason, for example, when a customer at a seat holds and takes out the deep dish from the conveyance path, there is some possibility that the container of the soft food or the beverage may topple down or the container being about to topple may fall down out of the deep dish.

SUMMARY

One objective of the present disclosure is to provide a holder which enables to suppress a container for a fluid to topple.

A first aspect of the present disclosure relates to a holder that houses a container for a fluid, the holder having:

a holder body having a bottom wall and a first side wall extending upward from a peripheral edge of the bottom wall, the first side wall having an upper end that defines an upper opening of the holder body; and a lid body having a top surface and a second side wall extending downward from a peripheral edge of the top surface, the lid body configured to selectively open and close the upper opening, in which when the container is housed in the holder, the upper end of the first side wall and a lower end of the second side wall are positioned below an upper end of the container, an area of the top surface is smaller than an area of the upper opening, and at least one of the top surface or the second side wall is in contact with the container or is configured to have a gap with the container such that the container is suppressed to tilt at a particular angle or more.

A second aspect of the present disclosure relates to the holder according to the first aspect, in which the holder houses a first container or a second container as the container, when the holder houses the first container, a lower end portion and an upper end portion of the first container are in contact respectively with the bottom wall of the holder body and the top surface of the lid body, and when the holder house the second container, a lower end portion of the second container is in contact with the bottom wall of the holder body, and an upper portion of the second container is positioned at a prescribed distance or less from at least one of the top surface or the second side wall of the lid body.

A third aspect of the present disclosure relates to the holder according to the first or second aspect, in which the second side wall has an expanding portion that expands from the second side wall, and the expanding portion is configured not to interfere with the container when the lid body opens by rotating about an end portion of the lid body opposite to the expanding portion.

A fourth aspect of the present disclosure relates to the holder according to any one of the first to third aspects, in which the lid body further includes a third side wall that surrounds an upper end portion of the first side wall and a locking member that is configured to bee movable relative to the third side wall, and the locking member switches between a locked state to fix the lid body to the holder body and a released state to allow the lid body to be removed from the holder body.

A fifth aspect of the present disclosure relates to the holder according to any one of the first to fourth aspects, in which the lid body further includes a lid peripheral portion continuously extending between the lower end of the second side wall and an upper end of the third side wall, and the lid peripheral portion has a portion that defines a groove.

According to the present disclosure, there is provided the holder for providing the soft food or the beverage, which enables to suppress the container of the soft food or the beverage to topple.

A seventh aspect of the present disclosure relates to a holder that houses a container for a fluid, the holder having:

a holder body having a bottom wall and a first side wall extending upward from a peripheral edge of the bottom wall, the first side wall having an upper end that defines an upper opening of the holder body; and a lid body having a top surface and a second side wall extending downward from a peripheral edge of the top surface, the lid body configured to selectively open and close the upper opening, wherein when the container is housed in the holder, the upper end of the first side wall and a lower end of the second side wall are positioned below an upper end of the container, an area of the top surface is smaller than an area of the upper opening, and at least one of the top surface or the second side wall is positioned close to the container such that the container tilts at a particular angle or less.

An eighth aspect of the present disclosure relates to a holder having:

a container for a fluid;

a holder body having a bottom wall and a first side wall extending upward from a peripheral edge of the bottom wall, the first side wall having an upper end that defines an upper opening of the holder body; and a lid body having a top surface and a second side wall extending downward from a peripheral edge of the top surface, the lid body configured to selectively open and close the upper opening, wherein when the container is housed in the holder body, the upper end of the first side wall and a lower end of the second side wall are positioned below an upper end of the container, an area of the top surface is smaller than an area of the upper opening, and the holder body has a size such that the container tilts at a particular angle or less.

BRIEF DESCRIPTION OF DRAWINGS

Exemplary embodiment(s) of the present invention will be described in detail based on the following figures, wherein.

DESCRIPTION OF EMBODIMENTS

1. Overview of Holder

Figure 1:
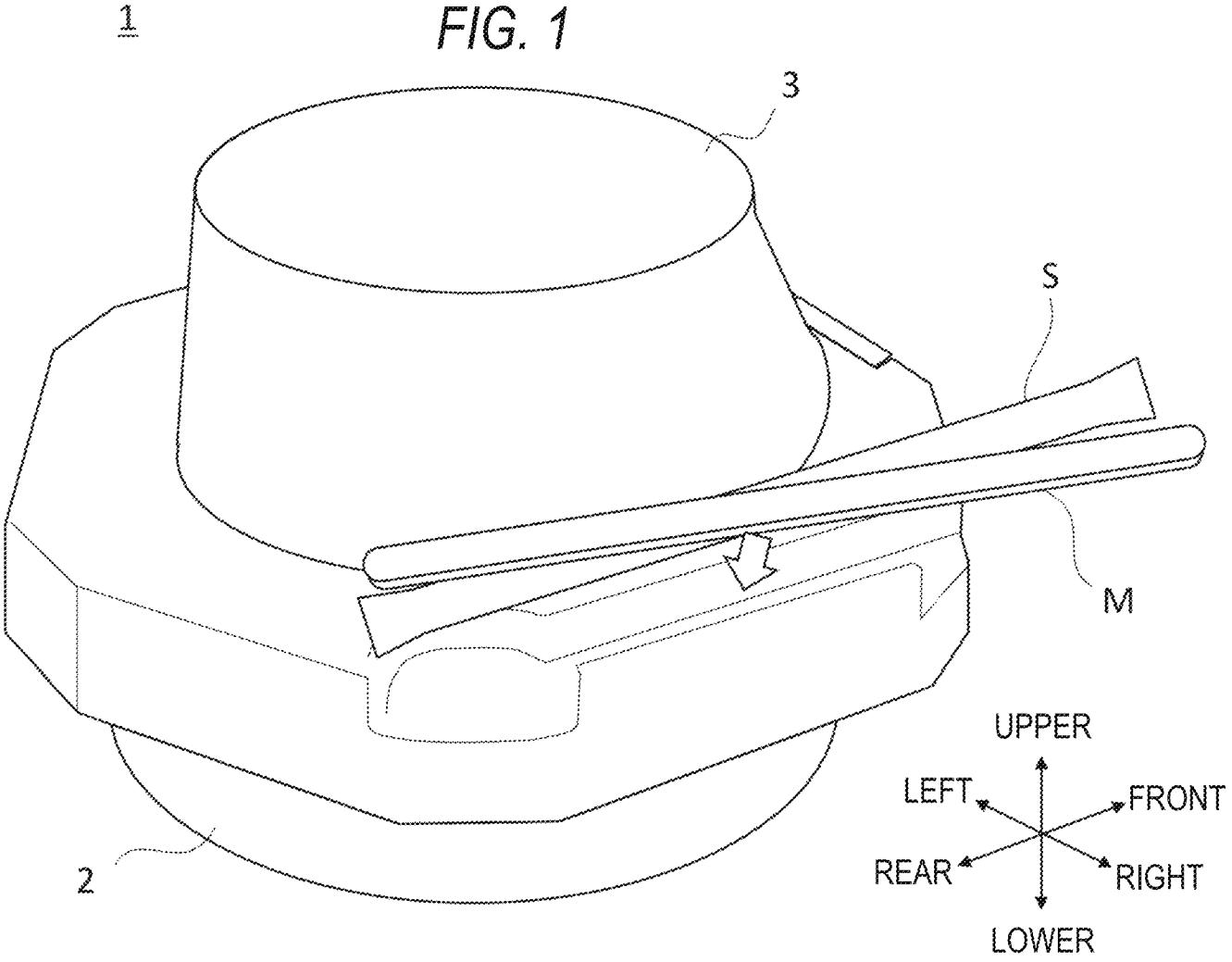
FIG. 1 is a perspective view of a holder for providing a soft food or a beverage according to an embodiment of the present disclosure.

Hereinafter, an embodiment of a holder 1 for providing a fluid such as a soft food or a beverage (hereinafter, also simply referred to as "holder 1") according to the present disclosure will be described with reference to the drawings. FIG. 1 is a perspective view of the holder 1 according to the present embodiment. Hereinafter, for convenience of description, the description will be made based on directions shown in FIG. 1. The other drawings will also be described in accordance with these directions. These directions are defined for describing the present embodiment, and the present invention is not limited to these directions. In the following drawings, a part of elements may be omitted for convenience of description.

The holder 1 is assumed to be mainly used in a restaurant such as a conveyor belt sushi restaurant. The restaurant is equipped with a food and beverage conveyance device (not shown). The food and beverage conveyance device has a conveyance path that revolves along seats for customers in the restaurant. A fluid such as a food and a beverage in a container is placed on the conveyance path to be conveyed to the seats. The holder 1 houses a container of a soft food or a beverage prepared in a cooking place or the like and conveyed to the seats along the conveyance path. The holder 1 can suppress the container to topple down when a customer at a seat takes out the container from the conveyance path, that is, when the customer takes out the container from the holder 1. It is therefore possible to provide a soft food and a beverage suitably.

The "fluid" in the present disclosure is not particularly limited to one. The fluid includes a food having high fluidity such as steamed egg custard, soup in a bowl, pudding, and jelly (i.e., a soft food). The fluid includes a beverage such as coffee, black tea, and juice. Such a soft food or a beverage is provided in a vertically elongated container having a certain depth. Examples of such a container are "bowls" including a tea bowl, a wood bowl, and a resin bowl, a drink cup, and a legged cup. Examples of the container according to the present embodiment are a bowl 4 and a drink cup 5, which are respectively used together with a lid 4*a* and a lid 5*a*. As will be described later, the holder 1 can be used for both the bowl 4 (second container) with the lid 4*a* and the drink cup 5 (first container) with the lid 5*a*.

Figure 2:
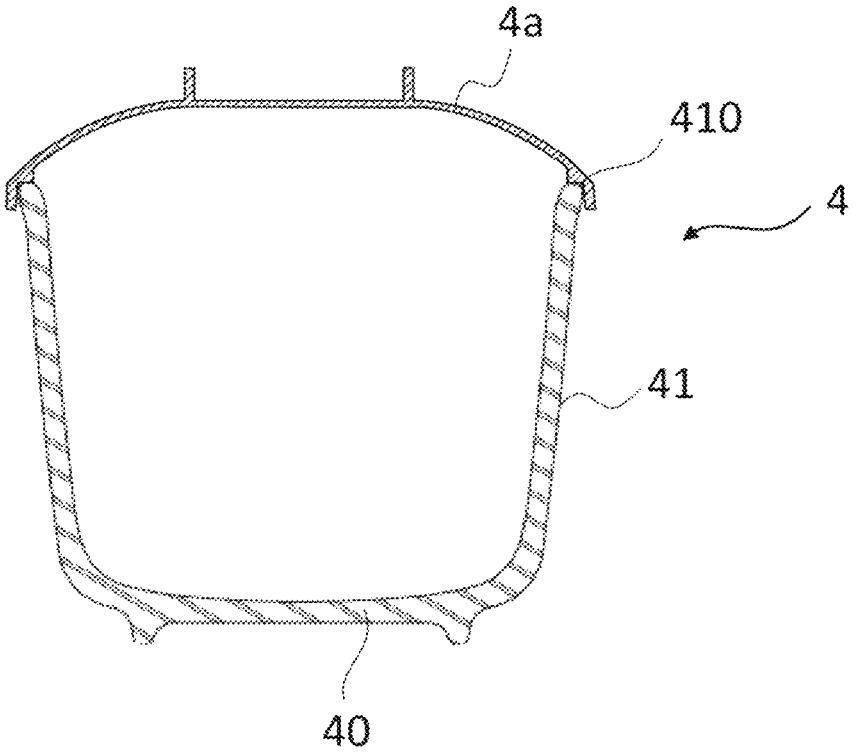
FIG. 2 is a sectional view showing an example of a container (second container)

FIG. 2 is a sectional view illustrating an example of the bowl 4 and the lid 4*a*. As shown in FIG. 2, the bowl 4 has a bottom surface 40 and a side surface 41 extending upward from a peripheral edge of the bottom surface 40. The bottom surface 40 has a substantially circular shape in a top view, and the bowl 4 also has a substantially circular shape in a top view. An upper end 410 of the side surface 41 defines an upper opening of the bowl 4. The lid 4*a* has a substantially circular shape in a top view, and covers the entire upper opening of the bowl 4 when placed on the upper end 410 of the side surface 41. Materials constituting the bowl 4 and the lid 4*a* are not particularly limited.

Figure 3:
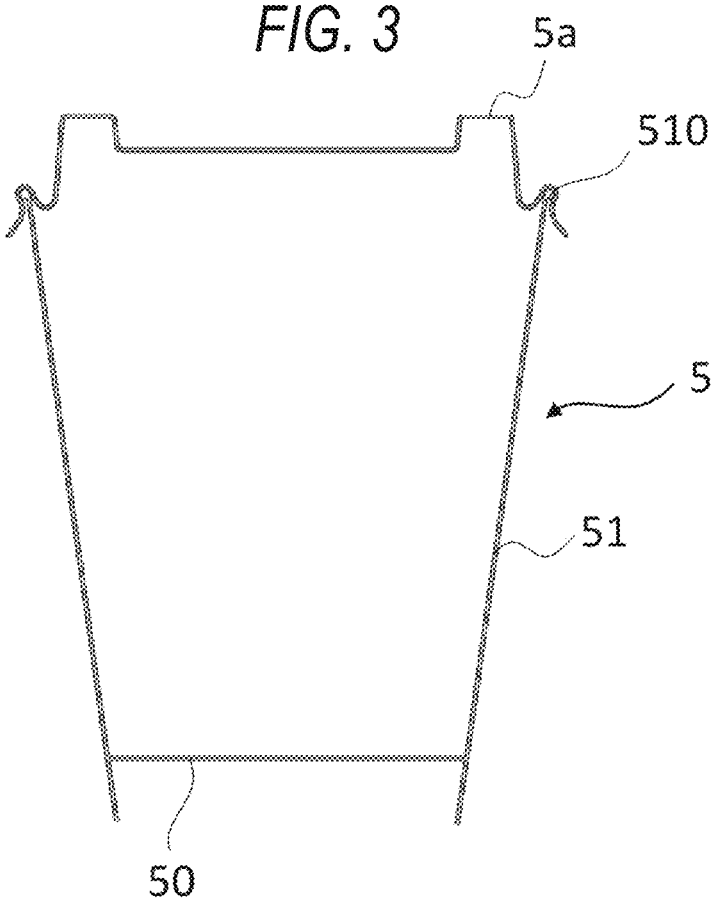
FIG. 3 is a sectional view showing another example of a container (first container)

FIG. 3 is a sectional view illustrating an example of the drink cup 5 and the lid 5*a*. As shown in FIG. 3, the drink cup 5 includes a bottom surface 50 and a side surface 51 extending upward from a peripheral edge of the bottom surface 50. The bottom surface 50 has a substantially circular shape in a top view, and the drink cup 5 also has a substantially circular shape in a top view. An upper end 510 of the side surface 51 defines an upper opening of the drink cup 5. The lid 5*a* is substantially circular in a top view, and covers the entire upper opening of the drink cup 5 when attached to the upper end 510 of the side surface 51. Materials constituting the drink cup 5 and the lid 5*a* are not particularly limited, and the drink cup 5 according to the present embodiment is made of paper and the lid 5*a* is made of resin. That is, the drink cup 5 and the lid 5*a* according to the present embodiment can be carried around.

2. Configurations of Holder

As shown in FIG. 1, the holder 1 includes a holder body (or a receptacle) 2 and a lid body 3. Hereinafter, each member will be described.

[Holder Body]

Figure 4:
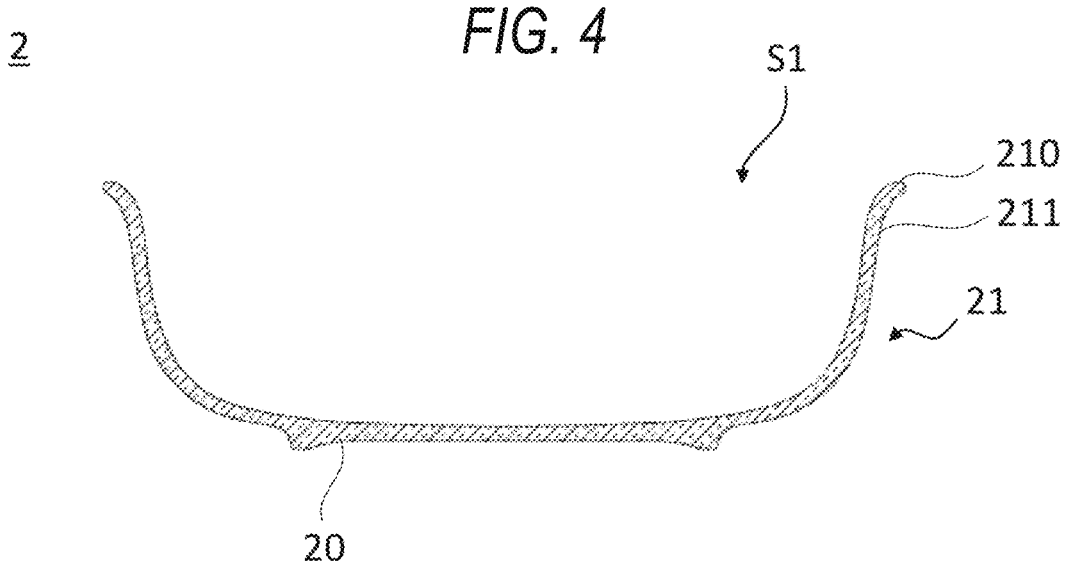
FIG. 4 is a sectional view of a holder body.

FIG. 4 is a sectional view of the holder body 2. The holder body 2 includes a bottom wall (or a base) 20 and a first side wall 21 extending upward from a peripheral edge of the bottom wall 20. The bottom wall 20 has a substantially circular shape in a top view, and the holder body 2 also has a substantially circular shape in a top view. The bottom wall 20 has a diameter larger than a diameter of the bottom surface 40 and a diameter of the bottom surface 50. The diameter of the bottom wall 20 is further larger than a diameter of a top surface 30 to be described later, so that the entire holder 1 is stable.

The first side wall 21 has a first end and a second end, and the first end is close to the bottom wall 20 than the second end. The second end of the first side wall 21 is at a first height from the bottom wall 20. The first height is less than a second height of the bowl 4. The first side wall 21 does not come into contact with but is spaced apart from the side surface 41 or the side surface 51 when the bowl 4 or the drink cup 5 is housed in the holder 1 (see FIGS. 9 and 10). An upper end 210 of the first side wall 21 defines an upper opening (or a mouth) S1 of the holder body 2. The first side wall 21 according to the present embodiment has an upper end portion 211 spreading radially outward and having an outer diameter thereof largest at the upper end 210. The upper end 210 is positioned below the upper end 410 or the upper end 510 in the state where the bowl 4 or the drink cup 5 is housed in the holder 1 (see FIGS. 9 and 10).

A material constituting the holder body 2 is not particularly limited, and may be, for example, a resin.

[Lid Body]

Figure 5:
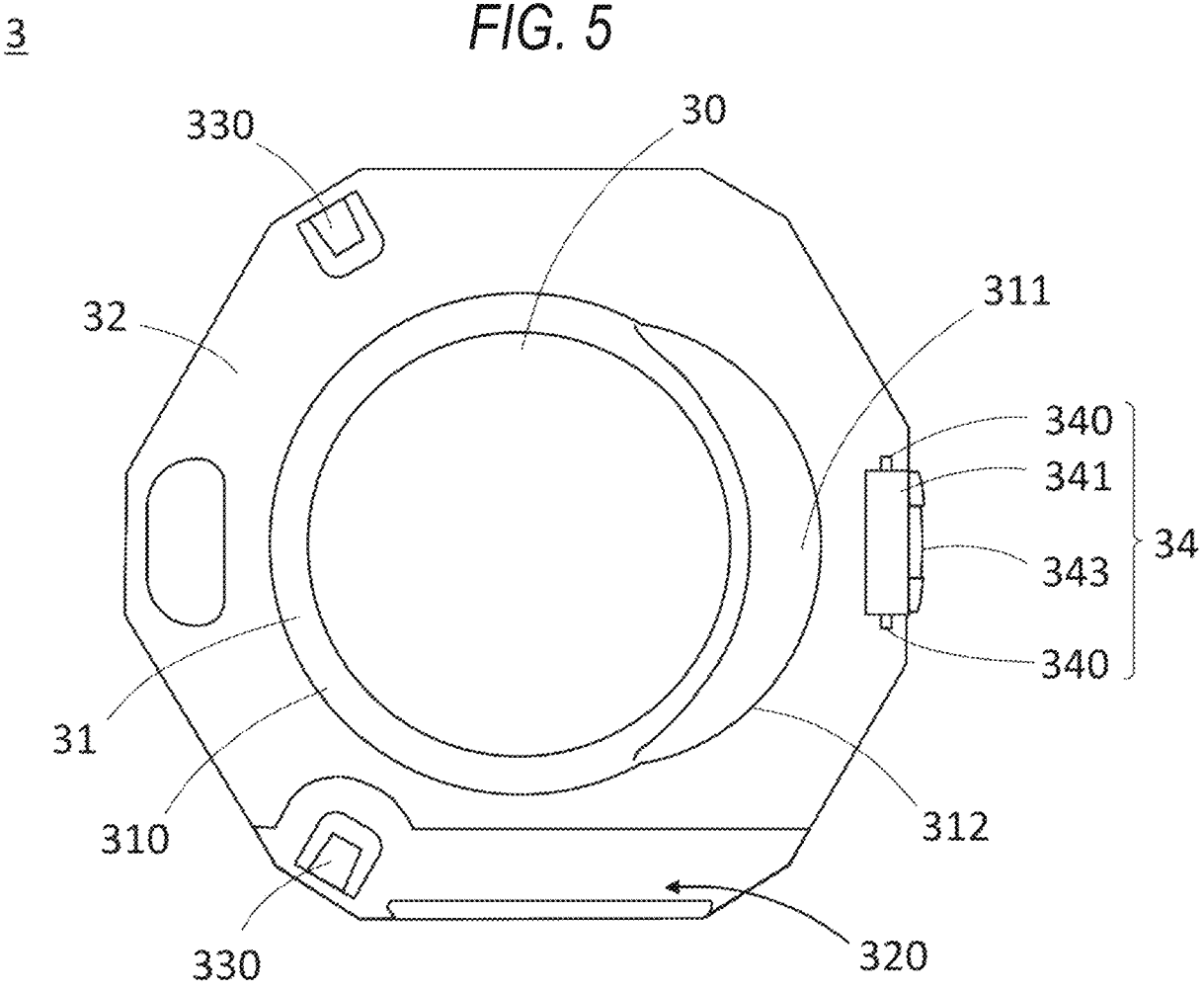
FIG. 5 is a top view of a lid body.
Figure 6:
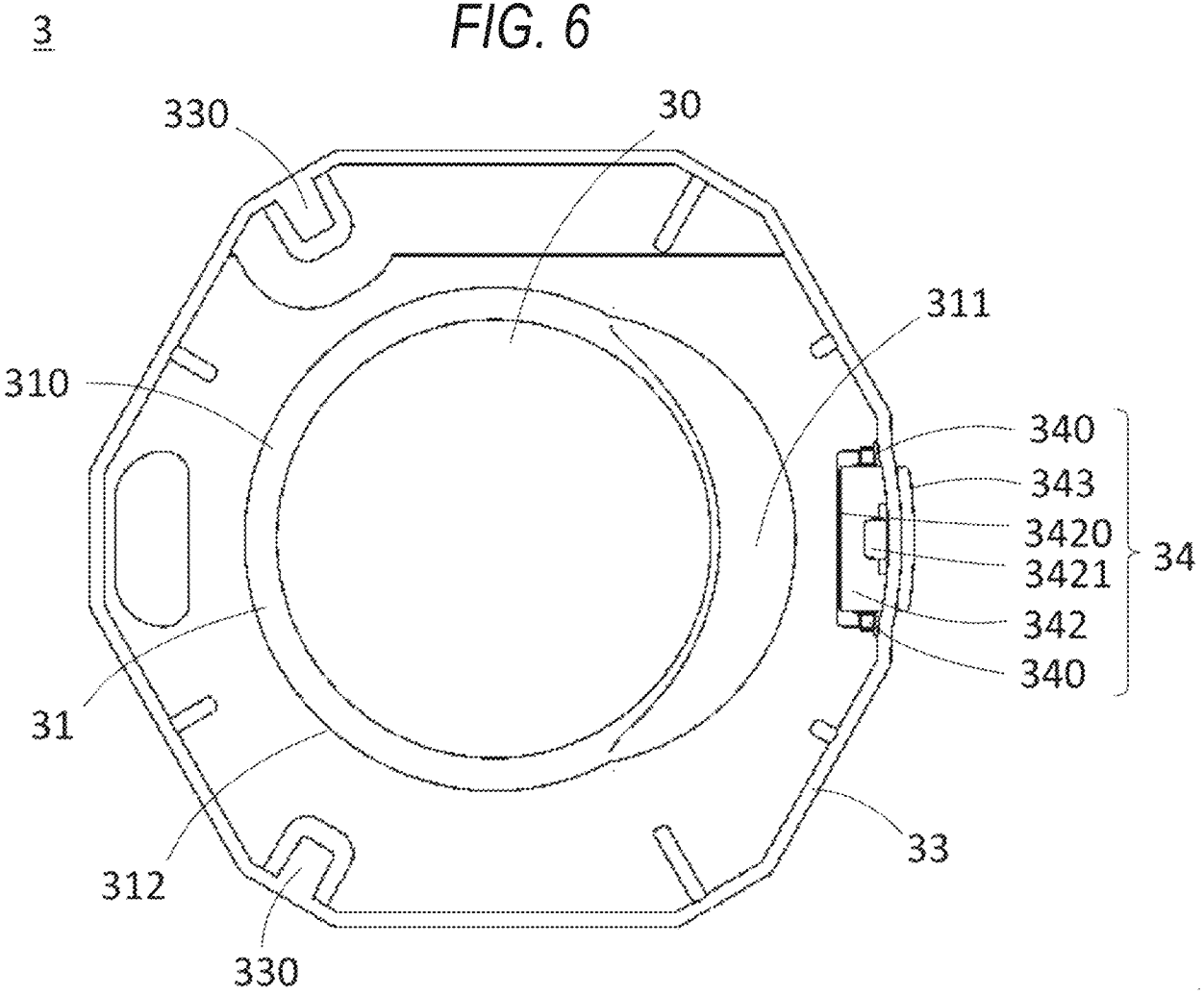
FIG. 6 is a bottom view of the lid body.
Figure 7:
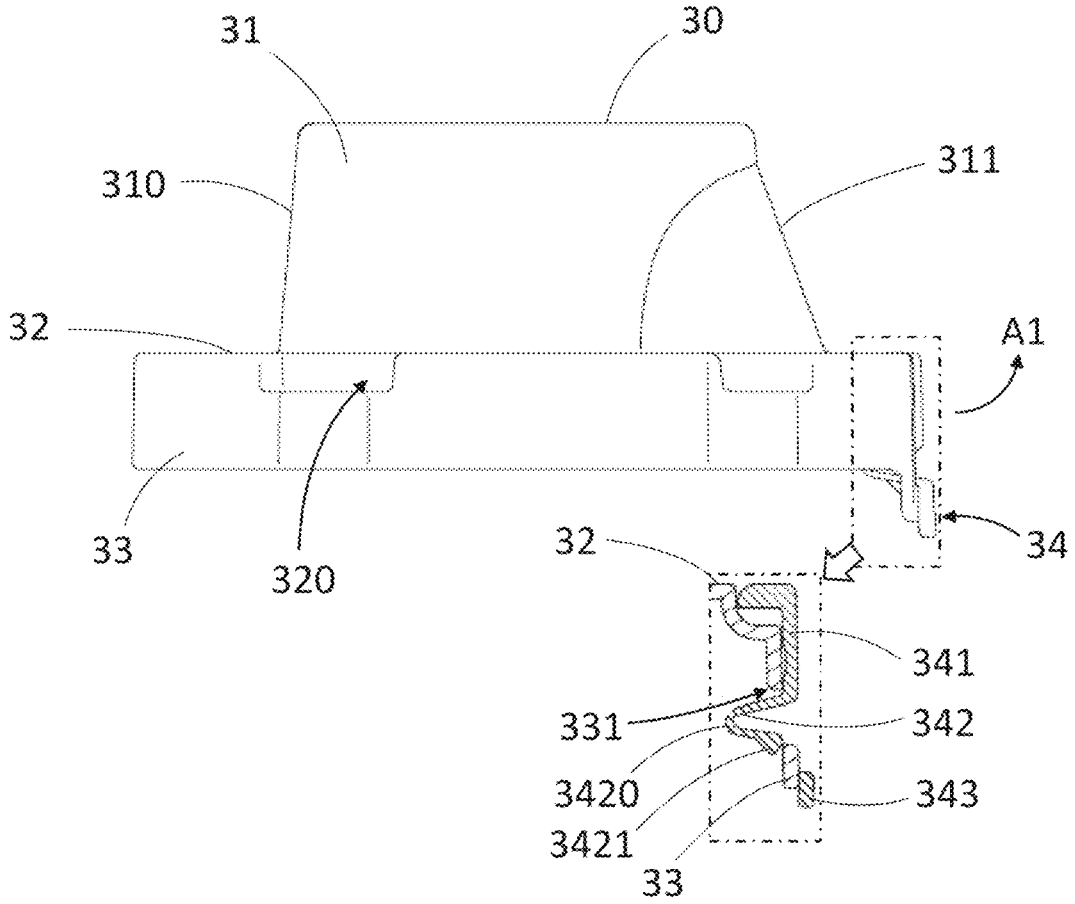
FIG. 7 is a right side view of the lid body.
Figure 8:
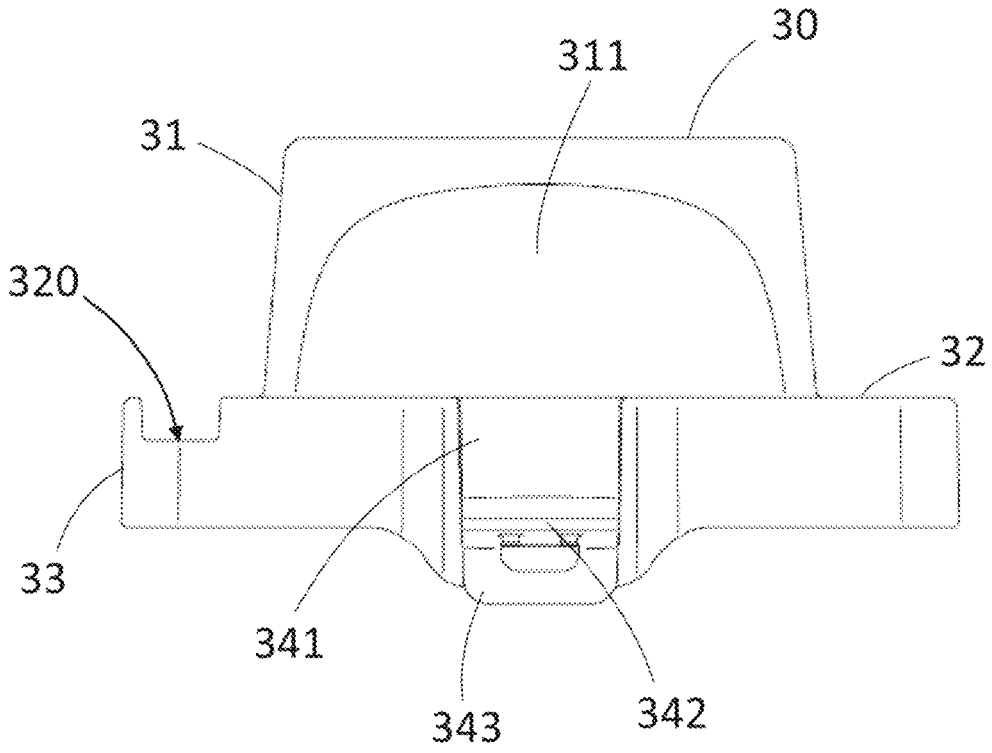
FIG. 8 is a front view of the lid body.

FIG. 5 is a top view of the lid body 3, FIG. 6 is a bottom view of the lid body 3, FIG. 7 is a right side view of FIG. 5, and FIG. 8 is a front view of the lid body 3. The lid body 3 can be attached to and detached from the holder body 2 and accordingly closes and opens the upper opening S1. The lid body 3 has the top surface (or a central portion) 30, a second side wall (or a rim) 31 extending downward from a peripheral edge of the top surface 30, a lid peripheral portion 32, a third side wall 33 extending downward from a peripheral edge of the lid peripheral portion 32, and a locking member 34. In the present embodiment, the top surface 30, the second side wall 31, the lid peripheral portion 32, and the third side wall 33 are integrally formed. Hereinafter, these portions may be collectively referred to as a "lid body".

The top surface 30 is an uppermost part of the holder 1, and is substantially circular in the present embodiment. The top surface 30 is positioned above the lid 4*a* in the state where the container is housed in the holder 1. Alternatively, in the state where the drink cup 5 with the lid 5*a* is housed in the holder 1, the top surface 30 is positioned above the lid 5*a* and in contact with the lid 5*a*. The top surface 30 has an area smaller than an area of the upper opening S1 of the holder body 2. In the present embodiment, an inner diameter of the top surface 30 is larger than a maximum diameter of a housed container or a lid thereof and smaller than an inner diameter of the upper end 210.

The second side wall 31 extends downward from the peripheral edge of the top surface 30 and is continuous with the lid peripheral portion 32 at a lower end 312. The lower end 312 is positioned below the upper end 410 or the upper end 510 in the state where the bowl 4 or the drink cup 5 is housed in the holder 1 (see FIGS. 9 and 10). The second side wall 31 has an expanding portion 310 in a part thereof. The expanding portion 310 has an inclined angle relative to the top surface 30, which is larger than that of a part other than the expanding portion 310 of the second side wall 31, and protrudes outward more than other portions in a side view. The inclined angle of the expanding portion 310 in a side view changes along the peripheral edge of the top surface 30, and is maximum at a maximum expanding portion 311. In the present embodiment, the maximum expanding portion 311 is positioned on a front side of the expanding portion 310 and corresponds to a position in which the locking member 34 described later is provided. The locking member 34 and a vicinity thereof are parts assumed to be lifted first in the lid body 3 when a customer opens the upper opening S1.

In the present embodiment, when a geometric center of the top surface 30 is set as a center and a position of the maximum expanding portion 311 is set at 0 degrees, the inclined angle of the expanding portion 310 in a side view decreases from 0 degrees to rotation positions of about ±60 degrees and remains at a constant inclined angle thereafter. For this reason, the lower end 312 has a shape in which a part of an outline of a circle protrudes while being curved forward in a top view.

The lower end 312 is continuous with the lid peripheral portion 32. The lid peripheral portion 32 is a portion protruding outward from the lower end 312, and extends in a substantially horizontal direction except for a part defining a groove 320 to be described later. The lid peripheral portion 32 is located radially outward of the upper end 210 of the holder body except for a part to which the locking member 34 is attached, and covers the entire upper opening S1 together with the top surface 30 and the second side wall 31.

A portion of the lid peripheral portion 32 defines the groove 320 recessed downward than the other part. The groove 320 according to the present embodiment is defined to extend in a front-rear direction on a right side of the lower end 312. In the groove 320, an item provided in association with the soft food or the beverage is housed as necessary. For example, when the beverage such as coffee and black tea is provided in the drink cup 5, the provided item may be granulated sugar housed in an elongated rod-shaped package (hereinafter, also referred to as a "stick sugar S") or a muddler M for stirring a beverage (see FIG. 1).

The peripheral edge of the lid peripheral portion 32 is continuous with an upper end of the third side wall 33. The third side wall 33 extends downward from the peripheral edge of the lid peripheral portion 32 and surrounds the upper end portion 211 of the holder body 2 from outside. The third side wall 33 is integrally formed with two claws 330. Each of the claws 330 is formed at a rotation position of about ±120 degrees with the geometric center of the top surface 30 as the center and the position of the maximum expanding portion 311 as 0 degrees. A tip of the claw 330 is positioned below the upper end 210 of the holder body. Accordingly, the claw 330 has the upper end 210 sandwiched between the claw 330 and the lid peripheral portion 32 to hold the upper end 210 when the lid body 3 is attached to the holder body 2.

The third side wall 33 has a through hole 331 in a front portion thereof (see FIG. 7). The through hole 331 has a substantially rectangular shape in a front view, into which a bent portion 342 of the locking member 34 is fitted. As will be described later, the through hole 331 has a lower peripheral edge engaging with a locking portion 3421 of the bent portion 342 to restrict movement of the bent portion 342. The lower peripheral edge of the through hole 331 according to the present embodiment is positioned forward of an upper peripheral edge thereof.

The locking member 34 is attached to a front end of the lid peripheral portion 32. The locking member 34 is movable relative to the lid body including the third side wall 33, and switches between a locked state of the holder 1 in which the lid body 3 is fixed to the holder body 2 and a released state of the holder 1 in which the lid body 3 is removable from the holder body 2. The locked state is a state in which the lid body 3 holds the upper end portion 211 of the holder body 2 in three positions by the two claws 330 and the locking member 34. In the locked state, the lid body 3 cannot be easily removed from the holder body 2 even when a force for pulling the lid body 3 upward is applied to the lid body 3. On the other hand, the released state is a state in which the locking member 34 does not hold the upper end portion 211 of the holder body 2. In the released state, when a force for pulling the locking member 34 or a vicinity thereof upward is applied, the lid body 3 is detached from the holder body 2 while inclining relative to the horizontal direction, and the two claws 330 are also separated from the upper end portion 211.

The locking member 34 includes a body 341, a pivot shaft 340 extending in a left-right direction from the body 341, the bent portion 342 continuous from a lower end of the body 341, and an operation portion 343 continuous from the bent portion 342. In the present embodiment, the portions 340 to 343 are integrally formed. The body 341 has a substantially L shape in a side view along the lid peripheral portion 32 and the third side wall 33. The pivot shaft 340 is formed in a substantially columnar shape, and is rotatably fitted into a groove or the like (not shown) formed in the lid peripheral portion 32.

The bent portion 342 is a part formed in a substantially V shape in a side view, and a top portion 3420 thereof having a V shape in the locked state faces the upper end portion 211 of the holder body 2. The locking portion 3421 protruding downward is formed at a lower portion of the bent portion 342. The bent portion 342 can be restorably compressed in a vertical direction by elasticity of a material constituting the bent portion 342. In the locked state of the holder 1, the bent portion 342 is fitted into the through hole 331 and is in contact with the upper end portion 211 of the holder body 2 at the top portion 3420. Further, in the locked state of the holder 1, the locking portion 3421 is caught on the lower peripheral edge of the through hole 331 from a rear side to restrict movement of the bent portion 342 (see FIGS. 9 and 10).

The operation portion 343 is a tab-shaped portion, and enables an operation for switching the locked state and the released state of the holder 1. The operation portion 343 is disposed outward of the third side wall 33, and a lower end thereof is positioned below a lower end of the third side wall 33. When the operation portion 343 is pulled out forward while the holder 1 is in the locked state, the locking portion 3421 is disengaged from the lower peripheral edge of the through hole 331, and the bent portion 342 is pulled out to outside of the third side wall 33. Accordingly, the holder 1 is brought into the released state. Subsequently, when the operation portion 343 is rotated in a direction of an arrow A1 in FIG. 7, the locking member 34 pivots about the pivot shaft 340, and a force for inclining and swinging the lid body 3 to the horizontal direction is applied to the lid body 3. When the lid body 3 is lifted while being inclined, the two claws 330 are eventually detached from the holder body 2, and the lid body 3 is completely separated from the holder body 2.

On the other hand, when the operation portion 343 is pushed rearward while the lid body 3 is covered on the holder body 2 and the holder 1 is in the released state, the bent portion 342 is fitted into the through hole 331. When the operation portion 343 is further pushed in and the top portion 3420 comes into contact with the upper end portion 211 of the holder body 2 and the locking portion 3421 is caught on the lower peripheral edge of the through hole 331, the holder 1 is brought into the locked state.

Materials constituting the lid body and the locking member 34 are not particularly limited, and are preferably a hard resin. Further, the lid body is preferably transparent or translucent so that a housed object can be grasped from outside of the holder 1.

3. Method for Using Holder

Hereinafter, a method for using the holder 1 when a container of a soft food or a beverage is housed in the holder 1 to provide it to a seat will be described.

First, a container of the soft food or the beverage is prepared in a cooking place or the like. The soft food or the beverage may be hot, at room temperature, or cooled. An employee or the like of the restaurant houses the container of the soft food or the beverage in the holder body 2 through the upper opening S1. The container is preferably disposed at a central portion of the bottom wall 20.

Next, the employee or the like attaches the lid body 3 to the holder body 2. More specifically, the lid body is aligned such that the top surface 30 of the lid body 3 is positioned above the container, and the two claws 330 are hooked on the upper end portion 211 of the holder body 2. Subsequently, an inclination of the lid body 3 is brought close to the horizontal direction so that the second side wall 31 does not interfere with the container. Thereafter, the operation portion 343 is pushed rearward (in a direction approaching the holder body 2), and the holder 1 is brought into the locked state. When the above-described item is provided, the stick sugar S or the muddler M is housed in the groove 320.

Figure 9:
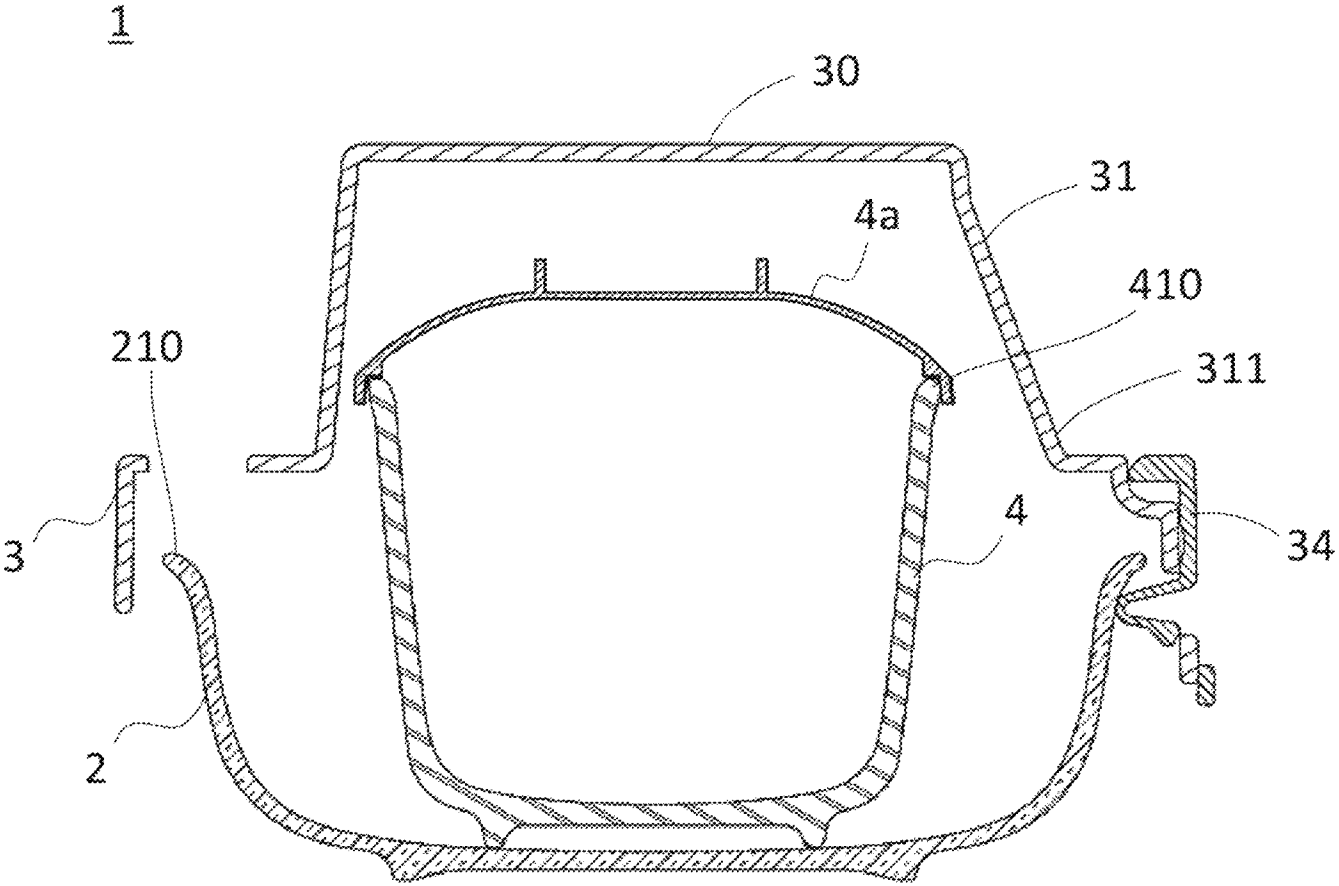
FIG. 9 shows an example of use of a holder.
Figure 10:
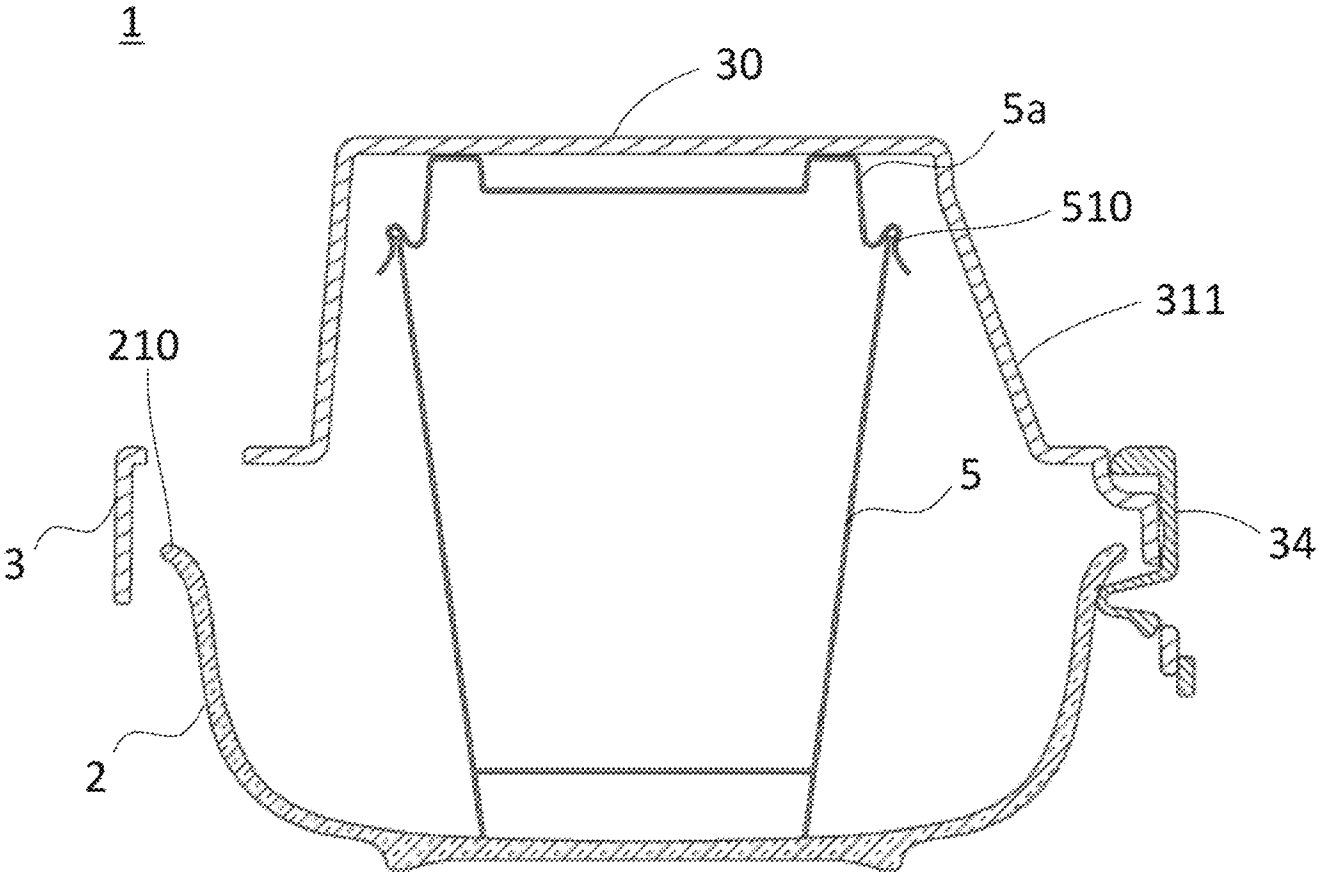
FIG. 10 shows another example of use of the holder.

FIG. 9 is a sectional view when the bowl 4 with the lid 4*a* shown in FIG. 2 is housed in the holder 1 and the holder 1 is in the locked state, and FIG. 10 is a sectional view when the drink cup 5 with the lid 5*a* shown in FIG. 3 is housed in the holder 1 and the holder 1 is in the locked state. As shown in FIG. 9, when the bowl 4 with the lid 4*a* is housed in the holder 1, a lower end portion thereof is in contact with the bottom wall of the holder body 2, and an upper end portion thereof is not in contact with the top surface 30 of the lid body 3. However, the second side wall 31 of the lid body 3 is positioned around the upper end 410 of the bowl 4, and only a small gap is defined among the second side wall 31, the lid 4*a* and an outer periphery of the bowl 4 in a vicinity of the upper end portion. That is, the second side wall 31 is positioned close to the lid 4*a* and the bowl 4. For this reason, the bowl 4 and the lid 4*a* are prevented from inclining over a certain degree in the holder body 2, and are prevented from toppling in the holder body 2. In other words, the bowl 4 and the lid 4*a* are suppressed to tilt at a particular angle or more (i.e., the bowl 4 and the lid 4*a* are allowed to tilt at a particular angle or less).

As shown in FIG. 10, when the drink cup 5 with the lid 5*a* is housed in the holder 1, a lower end portion thereof is in contact with the bottom wall of the holder body 2, and an upper end portion thereof is in contact with the top surface 30 of the lid body 3. That is, the drink cup 5 with the lid 5*a* is sandwiched from above and below by the lid body 3 and the holder body 2. For this reason, the drink cup 5 with the lid 5*a* is prevented from inclining in the holder 1, and is prevented from toppling in the holder body 2.

Thereafter, the employee or the like places the holder 1 in the locked state on the conveyance path. The holder 1 is placed on the conveyance path and conveyed to the seat.

The customer finds the desired holder 1 from the seat, takes out the holder 1 from the conveyance path, and places the holder 1 on a table. At this time, the container housed in the holder 1 does not topple even when the holder 1 slightly inclines, and thus flowable food is prevented from spilling out. Even if the holder 1 is fallen over at all by mistake, the lid body 3 is fixed to the holder body 2, so that a range in which the soft food or the beverage scatters around can be limited to be relatively narrow.

Subsequently, the customer pulls out the operation portion 343 forward to release the holder 1, and removes the lid body 3 from the holder body 2. At this time, an interval between the second side wall 31 and the container is ensured to be relatively large with the maximum expanding portion 311 as a center, and thus the second side wall 31 is less likely to interfere with the container. Accordingly, the container can be prevented from toppling due to the second side wall 31 interfering with the container when the lid body 3 is detached. Further, the diameter of the bottom wall 20 of the holder body 2 is larger than the diameter of the container, and the upper end 210 of the holder body 2 is positioned below the upper end of the container. For this reason, the holder body 2 is more stable, and a probability of toppling is fairly small.

Subsequently, the customer in the restaurant takes out the container from the holder body 2 to obtain the soft food or the beverage. As described above, since the upper end 210 of the holder body 2 is positioned below the upper end of the container, the customer can easily lift the container through the upper opening S1 and take out the container from the holder body 2.

4. Features

According to the holder 1 configured as described above, following effects can be obtained. (1) The area of the top surface 30 of the lid body 3 of the holder 1 is smaller than the area of the upper opening S1 of the holder body 2, and in the state where a container is housed in the holder 1, the upper end 210 of the first side wall 21 and the lower end 312 of the second side wall 31 are positioned below an upper end of the container. Accordingly, the container can be easily taken in and out through the upper opening S1. Since at least one of the top surface 30 or the second side wall 31 continuous with the top surface 30 is in contact with the drink cup 5 with the lid 5*a*, it is possible to prevent the container from toppling in the holder. Although the top surface 30 and the second side wall 31 continuous with the top surface 30 are not in contact with the bowl 4 or the lid 4*a*, a distance from the bowl 4 and the outer periphery of the lid 4*a* in the vicinity of the upper end portion thereof is equal to or less than a certain distance. For this reason, the bowl 4 and the lid 4*a* is suppressed to tilt at a particular angle or more in the holder body 2, and thus is suppressed to topple in the holder body 2. In other words, the top surface 30 or the second side wall 31 is position close to the bowl 4 and the lid 4*a* such that the bowl 4 tilts at the particular angle or less. Accordingly, it is possible to provide a soft food and a beverage in a way that makes the customer more at ease. Even if the holder 1 topples at all, since the inclination of the container inside the holder 1 is restricted, leakage of contents of the container can be reduced. "tilting at a particular angle or more" means, for example, the lid 4*a* is completely detached from the bowl 4 when the bowl 4 tilts at the particular angle.

The holder 1 according to the present embodiment may have the bowl 4 as a component of the holder 1. Then, the holder 1 according to the present embodiment has a size such that the bowl 4 tilts at the particular angle or less. More specifically, the holder body has a size such that the bowl 4 tilts at the particular or less. Accordingly, because of the configuration of the holder 1, the above-described features can be obtained.

(2) The expanding portion 310 of the lid body 3 has an inclined angle increasing toward the position in which the locking member 34 is provided, and the maximum expanding portion 311 is formed at a center of the locking member 34 in the left-right direction. For this reason, the second side wall 31 is less likely to interfere with the container when the lid body 3 is detached from the holder body 2, and the container is prevented from toppling due to the second side wall 31. That is, when locking by the locking member 34 is released and the lid body 3 is opened while being swung about an end portion (i.e., rotating about the end portion) on a side opposite to the locking member 34, the expanding portion 310 does not interfere with the container. Further, since the maximum expanding portion 311 is formed in a portion of the expanding portion 310, the second side wall 31 maintains a function of restricting the inclination of the container.

(3) The holder 1 includes the locking member 34 that makes the locked state in which the lid body 3 is fixed to the holder body 2. Accordingly, even if the holder 1 is fallen down by mistake, the lid body 3 is less likely to be detached from the holder body 2, and scattering of a fluid food or a beverage can be restricted.

(4) In a top view, the holder 1 has a shape in which the lid peripheral portion 32 and the third side wall 33 protrude most outward, and this part is easy to grip. In addition, the lid peripheral portion 32 and the third side wall 33 are farthest from the container housed in the holder 1, so that a temperature of the fluid food or the beverage is less likely to transmit thereto. Accordingly, the holder 1 can be easily gripped regardless of the temperature of the housed soft food or beverage.

(5) The lid body 3 has the groove 320 for housing a provided item. Accordingly, a proper item can be provided together with the soft food or the beverage timely, and quality of service is improved.

5. Modifications

Although an embodiment of the present disclosure is described above, the present invention is not limited thereto, and various modifications can be made without departing from the gist thereof. Following modifications can be combined as appropriate.

(1) In the above embodiment, the lid body 3 covers the upper end portion 211 of the holder body 2 from outside. Alternatively, the upper end portion 211 of the holder body 2 may cover the lid body 3 from outside.

(2) The shapes of the holder body 2 and the lid body 3 may be appropriately changed. For example, at least one of the bottom wall 20, the top surface 30, and the upper opening S1 may not be substantially circular. The shape of the second side wall 31 may be appropriately changed, the expanding portion 310 may be omitted, and the maximum expanding portion 311 may be omitted.

(3) The method for fixing the lid body 3 by the claws 330 and the locking member 34 may be appropriately changed. The shape, formation position, and number of the claws 330 are not particularly limited. The locking member 34 may be omitted.

(4) The shape and formation position of the groove 320 may be appropriately changed. In addition to or in place of the groove 320, a recess for housing a provided item such as portion milk may be formed. The groove 320 itself may be omitted.

(5) The container is not limited to the bowl 4 or the drink cup 5, and can be appropriately changed. These containers may not be used together with a lid.

The present disclosure may include the following technical aspect.

A container holder including:

a receptacle having a base and a sidewall extending non-parallel from the base, the sidewall having a first end and a second end, the first end being closer to the base than the second end, the second end being at a first height from the base, the first height being less than a second height of a container; and a lid having a central portion and a rim portion extending non-parallel from the central portion, the central portion being smaller than an area of a mouth of the receptacle and positioned over the receptacle, the rim portion being mated with the sidewall, wherein when the container with fluid is positioned in the receptacle, the container has a stable state and a tilted state, the fluid in the container maintained within the container in the tilted state, a size of the receptacle being such that the container tilts at an angle or less in the tilted state.

What is claimed is:

1. A holder that houses a container for a fluid, the holder comprising:

a holder body having a bottom wall and a first side wall extending upward from a peripheral edge of the bottom wall, the first side wall having an upper end that defines an upper opening of the holder body; and a lid body having a top surface and a second side wall extending downward from a peripheral edge of the top surface, the lid body configured to selectively open and close the upper opening, the second side wall having a first taper angle at a first circumferential location and a second taper angle at a second circumferential location positioned diametrically opposite the first circumferential location, the second taper angle being different from the first taper angle, wherein when the container is housed in the holder, the upper end of the first side wall and a lower end of the second side wall are positioned below an upper end of the container, an area of the top surface is smaller than an area of the upper opening, and at least one of the top surface or the second side wall is in contact with the container or is configured to have a gap with the container such that the container is restricted from tilting more than a threshold angle so as to prevent or suppress spillage or tipping.

2. The holder according to claim 1, wherein the holder houses a first container or a second container as the container, when the holder houses the first container, a lower end portion and an upper end portion of the first container are in contact respectively with the bottom wall of the holder body and the top surface of the lid body, and when the holder houses the second container, a lower end portion of the second container is in contact with the bottom wall of the holder body, and an upper portion of the second container is positioned at a prescribed distance or less from at least one of the top surface or the second side wall of the lid body.

3. The holder according to claim 1, wherein the second side wall has an expanding portion that expands from the top surface, and the expanding portion is configured not to interfere with the container when the lid body opens by rotating about an end portion of the lid body opposite to the expanding portion.

4. The holder according to claim 1, wherein the lid body further includes a third side wall that surrounds an upper end portion of the first side wall and a locking member that is configured to be movable relative to the third side wall, and the locking member switches between a locked state to fix the lid body to the holder body and a released state to allow the lid body to be removed from the holder body.

5. The holder according to claim 4, wherein the lid body further includes a lid peripheral portion extending between the lower end of the second side wall and an upper end of the third side wall, and the lid peripheral portion has a portion that defines a groove.

6. The holder according to claim 5, wherein the locking member being spaced from the lower end of the second side wall by the lid peripheral portion.

7. The holder according to claim 4, wherein the first circumferential location is positioned between the second circumferential location and the locking member, and the second taper angle is greater than the first taper angle.

8. The holder according to claim 1, wherein the fluid is a soft food or a beverage.

9. A holder that houses a container for a fluid, the holder comprising:

a holder body having a bottom wall and a first side wall extending upward from a peripheral edge of the bottom wall, the first side wall having an upper end that defines an upper opening of the holder body; and a lid body having a top surface, a second side wall extending downward from a peripheral edge of the top surface, a third side wall, a lid peripheral portion extending between a lower end of the second side wall and an upper end of the third side wall, and a locking member configured to selectively open and close the upper opening, the locking member being spaced from the lower end of the second side wall by the lid peripheral portion, wherein when the container is housed in the holder, the upper end of the first side wall and a lower end of the second side wall are positioned below an upper end of the container, an area of the top surface is smaller than an area of the upper opening, and at least one of the top surface or the second side wall is positioned close to the container such that the container is held within the holder so as to prevent or suppress spillage or tipping.

10. The holder according to claim 9, wherein the at least one of the top surface or the second side wall is in contact with the container.

11. The holder according to claim 9, wherein the fluid is a soft food or a beverage.

12. The holder of claim 9, wherein the second side wall of the lid body having circumferentially asymmetric taper angles.

13. A holder, comprising:

a container for a fluid;

a holder body having a bottom wall and a first side wall extending upward from a peripheral edge of the bottom wall, the first side wall having an upper end that defines an upper opening of the holder body; and a lid body having a top surface and a second side wall extending downward from a peripheral edge of the top surface, the lid body configured to selectively open and close the upper opening, the second side wall having a first taper angle at a first circumferential location and a second taper angle at a second circumferential location positioned diametrically opposite the first circumferential location, the second taper angle being different from the first taper angle, wherein when the container is housed in the holder body, the upper end of the first side wall and a lower end of the second side wall are positioned below an upper end of the container, an area of the top surface is smaller than an area of the upper opening, and the holder body has a size such that the container is held within the holder so as to prevent or suppress spillage or tipping.

14. The holder of claim 13, wherein the lid body further includes a third side wall that surrounds an upper end portion of the first side wall and a locking member that is configured to be movable relative to the third side wall.

15. The holder according to claim 14, wherein the first circumferential location is positioned between the second circumferential location and the locking member, and the second taper angle is greater than the first taper angle.

16. The holder according to claim 14, wherein the locking member being spaced from the lower end of the second side wall by a lid peripheral portion.

* * * * *